United States Patent [19]

Barnes et al.

[11] Patent Number: 4,463,631

[45] Date of Patent: Aug. 7, 1984

[54] MULTIPURPOSE OPENER

[75] Inventors: James E. Barnes; James G. Morkoetter; Norman M. Robbins, all of Fort Wayne, Ind.

[73] Assignee: Custom Tool, Inc., Ft. Wayne, Ind.

[21] Appl. No.: 439,070

[22] Filed: Nov. 4, 1982

[51] Int. Cl.[3] ..... B67B 7/44

[52] U.S. Cl. ..... 81/3.1 R; 81/3.46 R; 81/3.3 R; 7/151

[58] Field of Search ..... 81/3.1 R, 3.46 R, 3.3 R, 81/3.3 A, 3.34; 7/151; D8/18, 33, 37, 40; 220/270, 274

[56] References Cited

U.S. PATENT DOCUMENTS

| | | | |
|---|---|---|---|
| D. 265,047 | 6/1982 | Reel | D8/18 |
| 2,483,830 | 10/1949 | Hughes | 81/3.46 A |
| 2,727,415 | 12/1955 | Wendelken | 81/3.46 R |
| 3,235,122 | 2/1966 | Oblander | 220/274 |
| 4,133,228 | 1/1979 | DePooter | 81/3.1 R |
| 4,309,921 | 1/1982 | Miller | 81/3.46 R |
| 4,391,167 | 7/1983 | Bergmeister | 81/3.46 R |

*Primary Examiner*—Roscoe V. Parker

*Attorney, Agent, or Firm*—George A. Gust

[57] ABSTRACT

A multipurpose can opener is provided for opening bottles having caps, cans having pull-off tabs, and cans having stay-on tabs. Only one end of the opener is utilized for opening bottles and cans, the opposite end being used solely as a handle or lever. The operating end of the multipurpose opener has three hooks extending downwardly therefrom at predetermined points and a pair of projections extending downwardly therefrom along its side edges. A first hook and the projections are utilized in removing pull-off tabs wherein the hook engages the ring of the tab and the projections abut against the can shell to act as a fulcrum during the removal of the tab. A second hook is utilized for opening stay-on tabs and it is engaged with the tab and in conjunction with the distal end of the operating end separates the scored section of the can shell when the user lifts upwardly on the handle. For removing caps from bottles, a third hook is disposed below the edge of the cap, and the second hook is positioned on the top of the cap to act as a fulcrum during the removal of the cap by the third hook upon upward movement of handle.

5 Claims, 13 Drawing Figures

MULTIPURPOSE OPENER

BACKGROUND OF THE INVENTION

This invention pertains to an opener, and more particularly to a multipurpose opener for bottles and various cans such as those used for soft beverages and/or beer.

Several types of openers exist, some for opening bottles or cans, and others for opening jars or other non-standard containers having lids. As to those openers designed for bottles and cans, this invention pertains to one opener which will open bottles having caps, cans having pull-off tabs, and cans having stay-on tabs.

Generally, those prior art openers designed for bottles or cans will remove or open only two of the three types of closures: i.e., bottle caps, pull-off tabs, and stay-on tabs. Obviously, the possibility of having one of these openers which will not open one of the bottles or two different cans in the possession of the user is undesirable.

Furthermore, some prior art openers utilize both ends for opening bottles or cans, for example, one end being for a bottle and the opposite end for a can. Since these ends generally have sharp projections or edges, they may cause discomfort to the user grasping one end thereof in utilizing the opposite end for opening a bottle or can. This is particularly undesirable for individuals whose employment requires multiple openings of various bottles and cans, and those individuals in the older and younger age brackets.

Representative of the various openers mentioned above are U.S. Pat. Nos. 4,309,921; 4,133,228; 2,727,415; and 2,483,830.

SUMMARY OF THE INVENTION

In view of the above, there still exists a need for an opener which will open bottles and cans having various tabs. The present invention provides a solution to this need by providing a multipurpose opener which opens bottles having caps, cans having pull-off tabs, and cans having stay-on tabs. Moreover, the multipurpose opener of the present invention provides for the opening of these various containers by utilizing only one end thereof; the opposite end being used as a handle or lever for applying a force.

In one embodiment of the invention, there is provided a multipurpose opener comprising a flat elongate body having upper and lower surfaces, and opposing end portions angularly disposed to each other. The elongate body is bent at an obtuse angle intermediate its end portions. One of the end portions has on its lower surface a first hook extending downwardly therefrom and which has a remote end portion substantially parallel to the one end portion and directed in the general direction of the opposite end portion. This first hook is adapted to be inserted through the ring of a pull-off tab of a can and between the ring and the can shell. Between the first hook and the distal end of said one end portion are a pair of oppositely disposed projections extending downwardly from the lower surface and being a predetermined distance from the first hook. One or both of these projections may be adapted to abut against the top surface of the can shell when the ring is hooked by the first hook to thereby act as a fulcrum when the user lifts upwardly on the opposite end portion to remove the pull-off tab by the first hook.

A second hook is disposed on the lower surface of said one end portion at a predetermined distance from the distal end thereof and extends downwardly therefrom. The remote end portion of this second hook is substantially parallel to said end portion and directed in the general direction of the distal end. This second hook is adapted to be inserted under and against the lift tab of a stay-on tab of a can, and the distal end of the one end portion is adapted to abut against the top surface of the stay-on tab. Upon lifting upwardly on the opposite end portion, the distal end of the one end portion is forced downwardly against the stay-on tab to open the can. Here, the fastener for the stay-on tab serves as a fulcrum.

A third hook is also provided on the lower surface of the one end portion at a predetermined distance from the second hook and extends downwardly therefrom. The remote end portion of the third hook is substantially parallel to the one end portion and is directed in the general direction of the distal end thereof. The third hook is adapted to engage the peripheral edge of the lip of a bottle cap, and the second hook is adapted to abut against the top surface of the bottle cap, so that upon lifting upwardly on the opposite end portion, the second hook acts as a fulcrum during the removal of the bottle cap by the third hook.

It is an object of the present invention to provide a multipurpose opener which opens bottles having caps, cans having pull-off tabs, and cans having stay-on tabs.

Another object of the present invention is to provide a multipurpose opener wherein only one end portion thereof is used for the opening of bottles and cans.

BRIEF DESCRIPTION OF THE DRAWINGS

The above mentioned and other features and objects of the present invention, and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1:
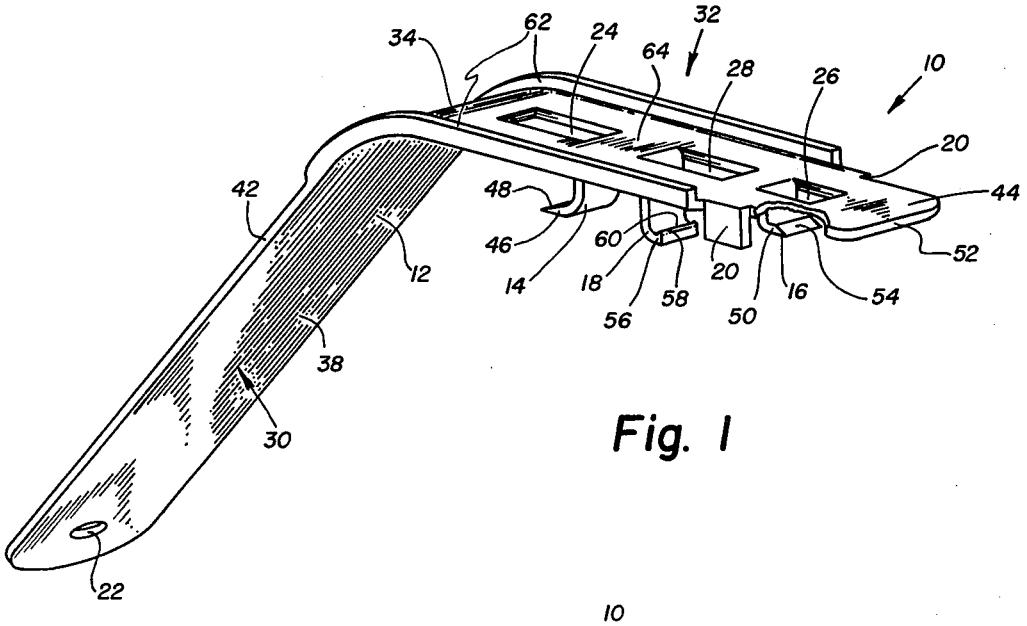
FIG. 1 is a broken-away perspective view of a preferred embodiment of the present invention.
Figure 2:
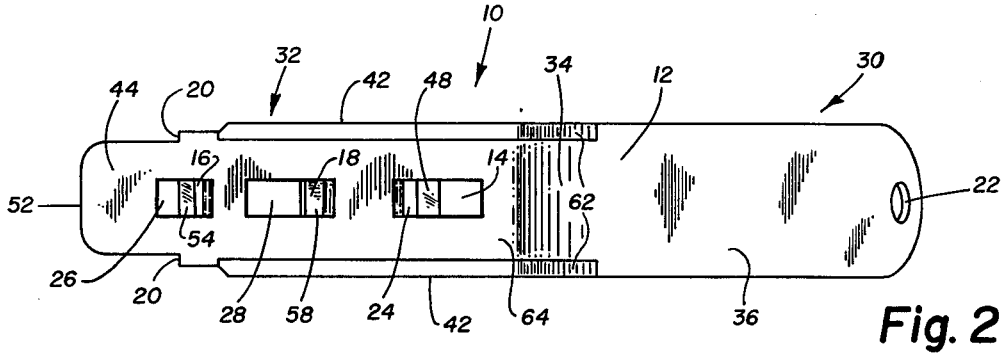
FIG. 2 is a top plan view of the embodiment of FIG. 1.
Figure 3:
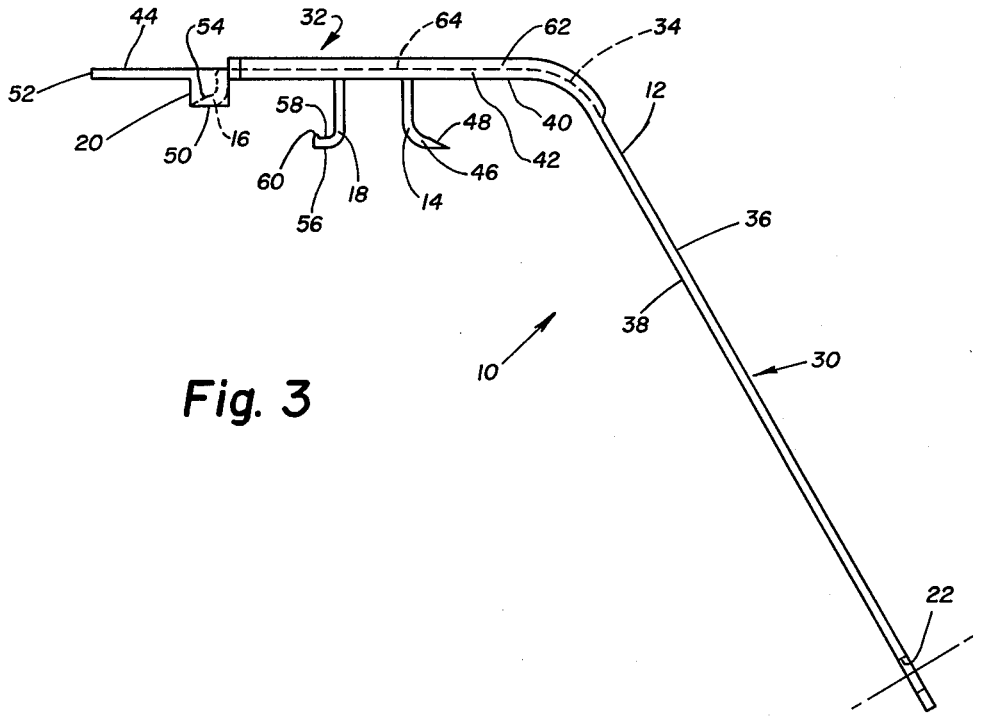
FIG. 3 is a side elevational view of the embodiment of FIG. 1.

Referring to FIGS. 1–3, multipurpose opener 10 comprises elongate body 12, hook 14, hook 16, hook 18, projections 20, and hole 22, all of which are fabricated from flat strip steel in a stamping process. Upon being formed in the process, hooks 14, 16, 18 leave stamped openings 24, 26, 28, respectively, in elongate body 12.

Multipurpose opener 10 has handle 30 integrally joined to operating end 32 at bend 34 which is formed to an obtuse angle during the stamping process. Handle 30 has an upper surface 36 and a lower surface 38, and is of a length suitable for the grasping thereof by the user. Handle 30 has hole 22 disposed therein for hanging multipurpose opener 10 and is without any sharp or projecting surfaces that would cause discomfort to the user.

Operating end 32 has extending downwardly from its lower surface 40 hooks 14, 16, 18 and projections 20, which are formed on side edges 42 during the stamping process. The remote end of operating end 32 has an extension or neck 44 which is of narrower width.

Hook 14 has remote end 46 that is substantially parallel to lower surface 40 and which points toward handle 30. Top surface 48 of remote end 46 is chamfered as illustrated in FIGS. 1 and 3.

Projections 20, which are downwardly disposed from side edges 42, are disposed a predetermined distance from hook 14, the predetermined distance being calculated from the diameter of the shell of the standard beverage can. The word shell is a term of art in the can manufacturing industry and refers to the formed lid of the can. The purpose of disposing projections 20 a predetermined distance from hook 14 will be disclosed hereafter in the operation of multipurpose opener 10.

Hook 16 extends downwardly from lower surface 40 a distance less than hook 14 and has remote end 50 which is substantially parallel to lower surface 40 and points in a direction towards distal end 52 of neck 44. Top surface 54 of remote end 50 is chamfered as illustrated in FIGS. 1 and 3. Distal end 52 is disposed a predetermined distance from hook 16, the distance being determined by the dimensions of the standard stay-on tab.

Hook 18 extends downwardly from lower surface 40 a predetermined distance from hook 16, and has remote end 56 disposed substantially parallel to lower surface 40. Top surface 58 of remote end 56 slopes upwardly at its end to form a slope or protuberance 60, which extends transversly of remote end 56.

A pair of edge-reinforcing flanges 62 are disposed upwardly from upper surface 64 of elongate body 12 and are formed thereon during the stamping process. Alternatively, elongated indentations 63 may be formed thereon as illustrated in FIGS. 7, 8, 9 and 13.

Figure 4:
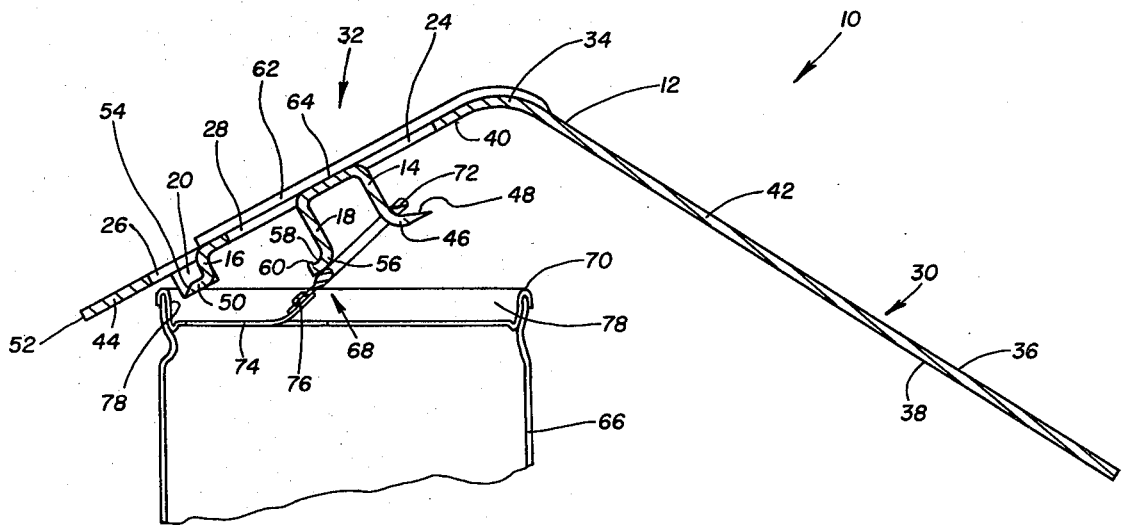
FIG. 4 is a side elevational, sectional view of the embodiment opening a can having a pull-off tab.

Referring to FIG. 4, the operation of multipurpose opener 10 with can 66 having pull-off tab 68 in shell 70 will be described. Pull-off tab 68 comprises ring 72 secured to scored section 74 of shell 70 by fastener 76. To remove pull-off tab 68, remote end 46 of hook 14 is inserted through ring 72 and drawn between ring 72 and shell 70. Should ring 72 be pressed or fitted into an indentation in shell 70, chamfered top surface 48 will assist the user in wedging remote end 46 between ring 72 and shell 70. When ring 72 has been fully captured or seated in hook 14 as illustrated in FIG. 4, the user rotates handle 30 upwardly so as to place projections 20 against inner surface or rim 78 of shell 70. Further upward movement of handle 30 causes hook 14 to separate scored section 74 from shell 70; projections 20 serving as a fulcrum bearing against rim 78 during upward movement of handle 30 to completely separate pull-off tab 68 from can 66. With projections 20 acting as a fulcrum, removal of pull-off tab 68 is easily accomplished with minimum effort. Further, because handle 30 is angularly disposed to operating end 32, removal of various closures, such as tab 68, is easily and conveniently done.

Figure 6:
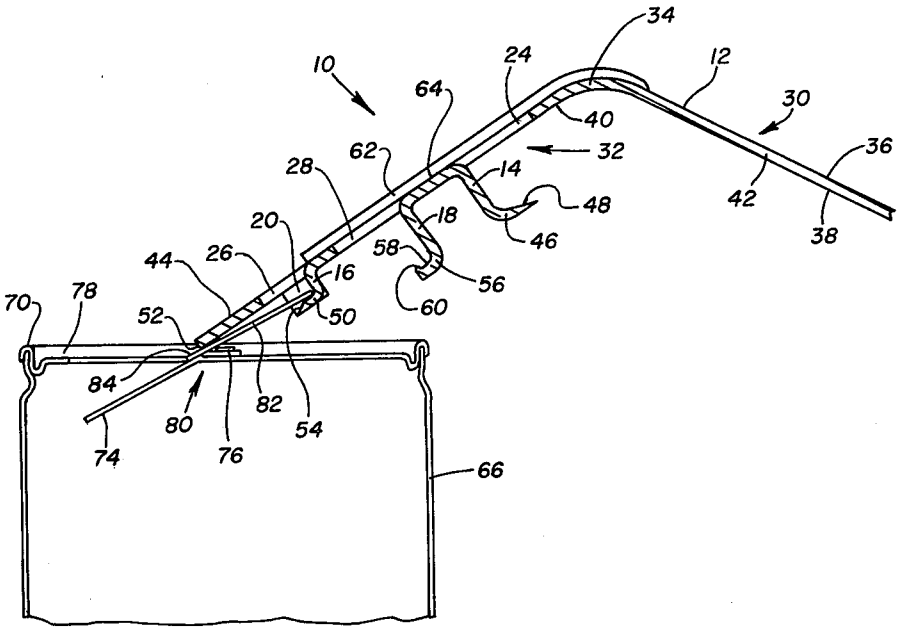
FIG. 6 is a broken-away side elevational, sectional view of the embodiment opening a can having a stay-on tab.

Referring now to FIG. 6, the use of multipurpose opener 10 with can 66 having stay-on tab 80 will be described. Stay-on tab 80 has lift tab 82 secured to shell 70 by fastener 76 and has an end portion 84 abutting against or secured to scored section 74. To open stay-on tab 80, the user positions hook 16 between lift tab 82 and shell 70, and, if lift tab 82 is pressed or fitted into an indentation in shell 70, chamfered top surface 54 assists in inserting hook 16 therebetween. Upon fully inserting hook 16 against lift tab 82, distal end 52 of neck 44 extends over stay-on tab 80 a distance just beyond the opposite side of fastener 76. Upon upward movement of handle 30, distal end 52 contacts lift tab 82 and serves as a fulcrum during further upward movement, wherein neck 44 will press downwardly on end 84 of lift tab 82 causing scored section 74 to break from shell 70 as illustrated in FIG. 6.

Figure 5:
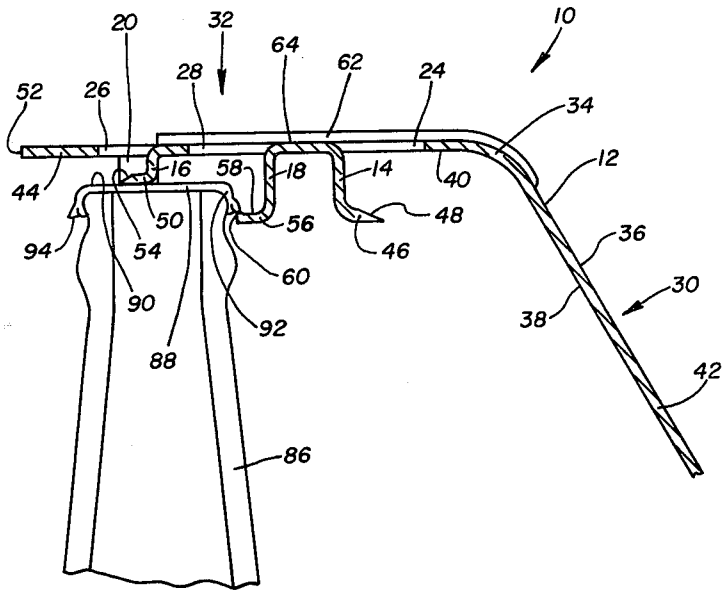
FIG. 5 is a broken-away side elevational, sectional view of the embodiment engaging a bottle cap for the removal thereof.
Figure 9:
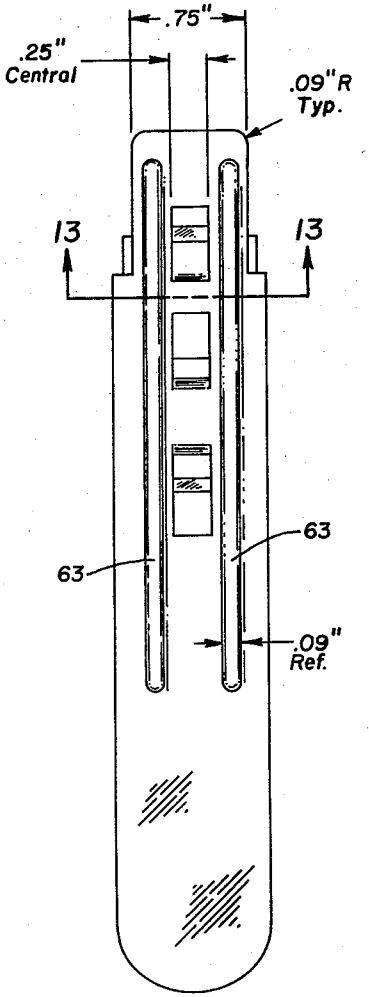
FIG. 9 is a top plane view of FIG. 7 with the operating end in the plane of the paper and the dimensions therefor.
Figure 8:
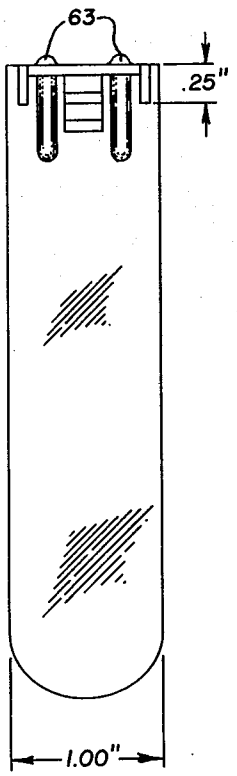
FIG. 8 is a top plan view of FIG. 7 with the handle in the plane of the paper and dimensions therefor.
Figure 7:
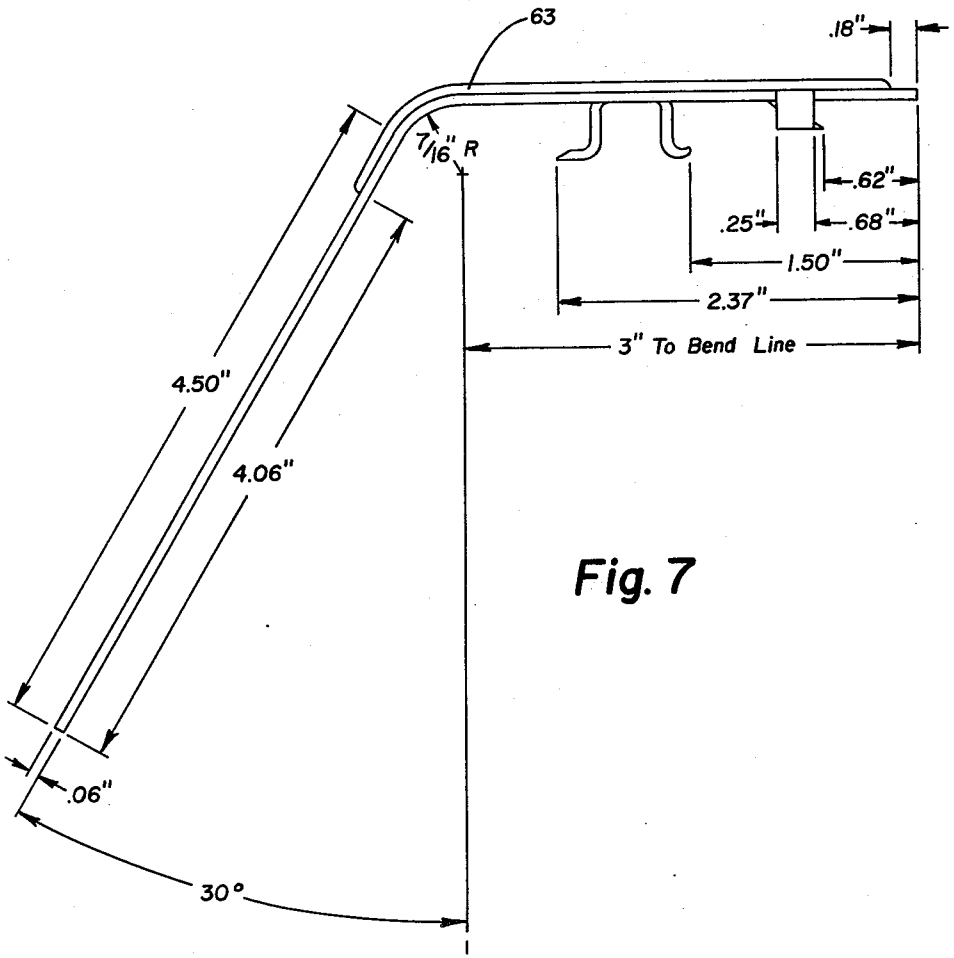
FIG. 7 is a side elevational view of a typical working embodiment of the present invention with dimensions therefor.
Figure 10:
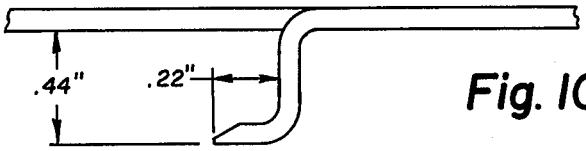
FIG. 10 is a broken-away, enlarged side elevational view of one hook of the embodiment of FIG. 7 with dimensions therefor.
Figure 11:
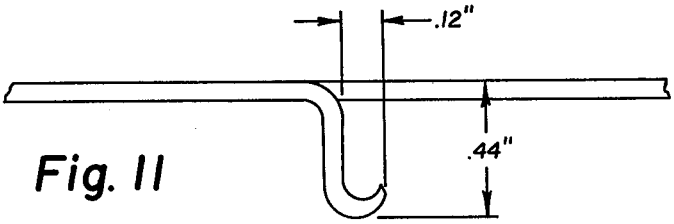
FIG. 11 is a broken-away, enlarged side elevational view of a second hook of the embodiment of FIG. 7 with dimensions therefor.
Figure 12:
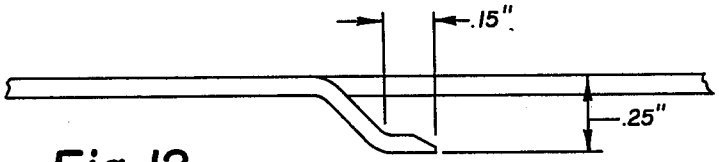
FIG. 12 is a broken-away, enlarged side elevational view of a third hook of the embodiment of FIG. 7 with dimensions therefor.
Figure 13:
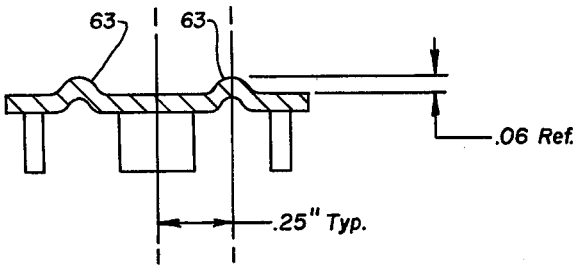
FIG. 13 is a sectional view of FIG. 9 along line 13—13 and viewed in the direction of the arrows with dimensions therefor.

Referring to FIG. 5, bottle 86 is depicted with cap 88 having top surface 90, lip 92, and peripheral edge 94. To remove cap 88 from bottle 86, the user positions hook 18 below lip 92 so that protuberance 60 fits between edge 94 and bottle 86. Moving handle 30 upwardly causes hook 16 to abut against top surface 90 to act as a fulcrum during the removal of cap 88. With continued upward movement of handle 30, hook 18 will remove cap 88 by drawing lip 92 radially outwardly and top surface 90 upwardly, with hook 16 acting as a fulcrum during the removal.

As described above, multipurpose opener 10 easily opens bottles 86 having caps 88, cans 66 having pull-off tabs 68, and cans 66 having stay-on tabs 80 with minimum effort. Further, the design of multipurpose opener 10 permits bottles 86 and cans 66 to be opened by the same end 32, the opposite end being used as a handle or lever 30 during the operation thereof, thereby eliminating any discomfort to the user caused by sharp or projecting surfaces.

FIGS. 7–13 illustrate a typical working embodiment of opener 10 with dimensions therefor based on dimensions of the present types of bottles 86 and cans 66. Only indentations 63 have reference numerals; the remaining numerals are not shown for purposes of clarity regarding the dimensions, which are optimum for bottles 86 and cans 66.

While this invention has been described as having a preferred design, it will be understood that it is capable of further modification. This application is therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A multipurpose opener for cans having pull-off tabs or stay-on tabs on the shells thereof and bottles having caps, comprising:

a flat elongate body having upper and lower surfaces, opposite side edges, and opposing end portions, one of said end portions having on its lower surface a first hook member extending downwardly therefrom, a remote end portion of said first hook member being substantially parallel to said one end portion and pointing in the general direction of the opposite end portion, said remote end portion being adapted to be inserted through the ring member of a pull-off tab of a can and between the ring member and the can shell to thereby hook the ring member by said first hook member, said one end portion having disposed between said first hook member and the distal end of said one end portion at least one projection extending downwardly from said lower surface, said projection being a predetermined distance from said first hook member and adapted to abut against the inner surface of the can shell when the ring member is hooked by said first hook member, whereby, upon lifting upwardly on said opposite end portion, said projection acts as a fulcrum during the removal of the pull-off tab by said first hook member, said opposite end portion being elongated and serving as a handle, a second hook member on said lower surface of said one end portion at a predetermined distance from the distal end of said one end portion and extending downwardly therefrom, a remote end portion of said second hook member being substantially parallel to said one end portion and pointing in the general direction of said distal end, said second hook member remote end portion being adapted to engage the stay-on tab of a can and said distal end being adapted to abut against the top surface of the stay-on tab, whereby, upon lifting upwardly on said opposite end portion, said distal end acts as a fulcrum during the opening of the can by said second hook member.

2. The opener of claim 1 wherein said elongate body is bent at an obtuse angle to provide said end portions.

3. The opener of claim 2 wherein said remote end portion of said first hook member is chamfered on its top surface to facilitate its insertion between opposing surfaces.

4. The opener of claim 3 wherein said remote end portion of said second hook member is chamfered on its top surface to facilitate its insertion between opposing surfaces.

5. The opener of claim 3 further including a third hook member on said lower surface of said one end portion at a predetermined distance from said second hook member and extending downwardly therefrom, a remote end portion of said third hook member being substantially parallel to said one end portion and pointing in the general direction of said distal end, said third hook member being adapted to engage the peripheral edge of a bottle cap, and said second hook member adapted to abut against the top surface of the bottle cap, whereby, upon lifting upwardly on said handle end portion, said second hook member acts as a fulcrum during the removal of the bottle cap by said third hook member.

* * * * *